US006773063B2

(12) United States Patent
Eerkens

(10) Patent No.: US 6,773,063 B2
(45) Date of Patent: Aug. 10, 2004

(54) CHILD'S CHAIR CONSTRUCTION

(76) Inventor: Cornelis Eerkens, Lawick van Pabststraat 32, 6814 HJ Arnhem (NL)

( * ) Notice: Subject to any disclaimer, the term of this patent is extended or adjusted under 35 U.S.C. 154(b) by 97 days.

(21) Appl. No.: 10/136,077

(22) Filed: Apr. 29, 2002

(65) Prior Publication Data

US 2003/0038516 A1 Feb. 27, 2003

(30) Foreign Application Priority Data

Aug. 24, 2001 (NL) ..... 1018828

(51) Int. Cl.[7] ..... A47C 15/00
(52) U.S. Cl. ..... 297/248; 297/440.14
(58) Field of Search ..... 297/248, 440.1, 297/440.15, 440.23, 440.14, 440.13, 3, 118, 119, 130, 153, 170, 217.1, 283.1, 283.2, 463.1, 283.3, 1; 312/257.1, 263, 265.5, 107, 108, 111

(56) References Cited

U.S. PATENT DOCUMENTS 2,532,863 A * 12/1950 Taylor
2,721,632 A * 10/1955 Surpierre
2,785,940 A * 3/1957 Felton
3,188,138 A * 6/1965 Lockshin
3,233,942 A * 2/1966 Creutz
D218,420 S * 8/1970 Weidner ..... D6/338
3,552,579 A * 1/1971 Simon et al.
3,563,624 A * 2/1971 Stice
3,570,418 A * 3/1971 Gooding et al. ..... 108/12
D220,997 S * 6/1971 Svezia et al. ..... D6/335
3,592,506 A * 7/1971 Breslow ..... 297/188.1
3,788,700 A * 1/1974 Wartes
3,834,776 A * 9/1974 Becker, Jr. et al. ..... 312/108
4,239,306 A * 12/1980 Klaus
4,311,337 A * 1/1982 Brunn
4,410,093 A * 10/1983 Chiariello et al.
4,593,950 A * 6/1986 Infanti
4,684,172 A * 8/1987 Lundquist ..... 297/248
4,763,580 A * 8/1988 Garland ..... 108/91
5,765,917 A * 6/1998 Johnson
6,012,773 A * 1/2000 Best
D437,692 S * 2/2001 Smith
6,367,874 B2 * 4/2002 Casini
6,568,058 B1 * 5/2003 Wieland et al.

* cited by examiner

*Primary Examiner*—Peter M. Cuomo
*Assistant Examiner*—Stephen Vu
(74) *Attorney, Agent, or Firm*—R. Neil Sudol; Henry D. Coleman; William J. Sapone

(57) ABSTRACT

An operating principle or method and a construction for small chairs that can be utilized by children to form playthings at home or at the nursery, crèche or kindergarten. When such chairs are being coupled with U-shaped clamps, a variety of doll's furniture can be created by the children themselves. The child's furniture is safe and easy to handle while assembling or disassembling them. Combinations of said chairs could form such playthings as barns, high rise buildings, doll houses, a doll's crib, a bed, a puppet theatre, a couch, an umpire seat and so on.

11 Claims, 2 Drawing Sheets

CHILD'S CHAIR CONSTRUCTION

BACKGROUND OF THE INVENTION

This invention relates to children's play furniture. More particularly, this invention relates to a construction of small chairs that can be utilized by children to form playthings at home or at the nursery, crèche or kindergarten. This invention also relates to a method of assembling and disassembling play furniture.

OBJECT OF THE INVENTION

It is an object of this invention to provide means of construction of play furniture and an operating method that cannot harm children when in play they assemble and disassemble the play furniture.

Other objects of the invention will be apparent from the drawings and descriptions hereof.

SUMMARY OF THE INVENTION

The present invention is directed in part to play chairs for children and provides a tool and an operating principle or method of using the tool. Each chair has facilities to clamp one or more other chairs to its side, front or bottom—either in normal or upside down positions—simply by plugging the peg-ends of clamps (U-shaped pieces) in connecting holes that are named slot-holes. By connecting the play chairs with the special coupling clamps, small children can make puppet furniture such as barns, high rise buildings, doll-houses, a crib, a bed, a puppet theatre, a couch, an umpire seat and so on. Toddlers may need some help to get started making their first plaything. For small children there is an increasing need to develop skills while playing. It requires tools designed to generate and challenge creativity, fantasy and locomotion ability.

The operating principle of this invention for assembling the child's chairs is characterized by the following procedures:

- releasing the idle U-shaped clamps from the storage holes by leverage with the help of a levering-end of a "design" club or stick, named clamp-lever;
- combining the chairs by placing them next to each other, or alternatively, one in an upside down or reversed position on top of the other;
- coupling the chairs with the clamps by engaging each peg-end of a clamp in a matching slot hole of a chair in the combination; and
- tightly wedging the peg-ends in the slot holes by tapping the clamp's bow with the fat tapping-end of the "design" club or stick, named clamp-tapper.

The methodology in this invention using the child's chair is further characterized by the following procedures for disassembling:

- positioning the levering-end of the "design" club or stick underneath the bow of a clamp that connects two of the child's chairs;
- leveraging and/or lifting the clamp out of the slot holes with the levering-club; and
- putting clamps back at the storage holes.

A desired design of this invention relates to a child's chair construction with rectangular boards for the seat, the two sides and the back. The boards' planes are fixed together at right angles with glue and/or pegs or screws. The height of the leaning part of the back board has the same height as the seat above the ground level minus the thickness of the sitting board. In view of the many options to make combinations all boards have slot holes pierced at specifically chosen points near the edges and corners of the boards. The distance of the shortest perpendicular line between slot holes and the edge of the seat plane, the back plane and the side planes as well as the virtual front plane and the virtual ground level plane are equal and 0.5 b in length. Whereby b is a fixed distance between the peg-ends of the clamp. The distance b will be preferably about 6 centimeter when the chair is made with dimensions of 25 cm width, and 17 cm height of the seat. The diameter of the slot-holes are equal to the diameter of the peg-ends of a clamp.

In case of an upside down combination of chair couplings there are extra slot holes provided in the edges between (and parallel) the boards' planes at the front of the side boards or in the edges between (and parallel) the seat boards' planes. The distance between matching slot-holes of the first chair and the second chair in all cases is again b cm. Anyway, in alternative designs there are possibilities of a multiple amount of slot-holes at places where the peg-ends of the clamps can exercise their coupling function. Furthermore, windows can be made in the boards for decoration and also to lower weight. These windows can be chosen to be made circular, square or any other fantasy figure. The decorative alternatives are not shown in the figures.

In the desired design of clamps for coupling the chairs relate to clamps that are formed in a U-shape i.e. approximately halve a ring and having an elastic spring stiffness of steel that will not deform when applied in performance. By experience with a number of prototypes it was observed that clamps made from a rod with a diameter between 6 and 8 mm thickness and with peg-ends distance of 6 to 8 cm would suffice to make a successful coupling, particularly when such chairs are 25 cm of width and 17 cm of height.

To every small chair belong at least two clamps, implying that with every coupling of two chairs four clamps are used for the construction of a piece of doll furnishing. During construction the peg-ends of a clamp are tapped in the slot-holes preferably by a wooden stick or "design" club. The thin end of the "design" club or stick can be used as a leverage tool to lift the clamps out of their slot-holes for disassembling the furniture.

In an alternative design the planes of the boards at the sides together with the seat board and the ground level plane would form a cube.

BRIEF DESCRIPTION OF THE DRAWINGS

In order that the invention may be more fully understood it will now be described, by way of example, with reference to the accompanying drawings in which.

DESCRIPTION OF THE PREFERRED EMBODIMENTS

Figure 1:
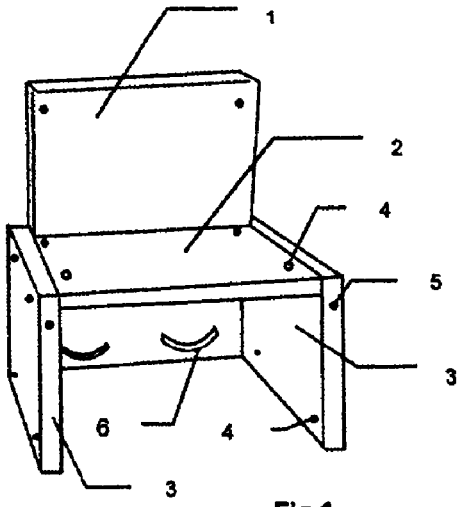
FIG. 1 shows a perspective drawing of the preferred child's chair.

The details of the drawing in FIG. 1 show in perspective a preferred design in which the back board 1 is attached with right angles to the seat board 2 as well as the side boards 3 forming altogether a child's chair and whereby the small circles 4 indicate the positioning of slot-holes that are pierced through the boards. Moreover, extra slot-holes 5 are shown that are drilled a few centimeters deep in the side boards parallel with the planes of the side boards and the seat board. In this drawing also two U-shaped clamps 6 are shown that are engaged in the slot-hole position for the preferred storage of clamps when they are not active in their coupling function.

Figure 2:
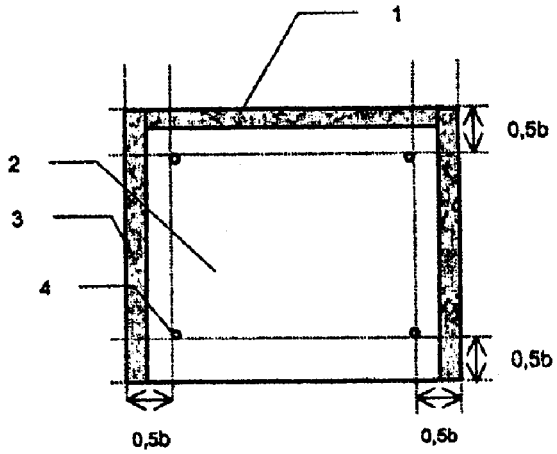
FIG. 2 shows a detail in top view.

The drawing of FIG. 2 is an enlargement of a top down view of the preferred child's chair whereby the position of the slot-holes 4 are specified at a distance of 0.5 b from the edges. In this regard b is the distance between the peg-ends of a clamp.

Figure 3:
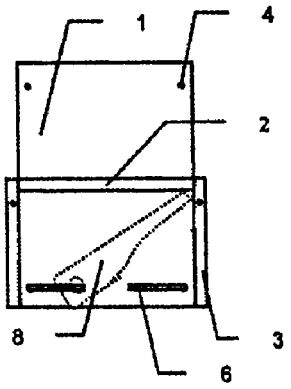
FIG. 3, FIG. 4, and FIG. 5, show an overview of respectively a front view, a back view and a side view.
Figure 4:
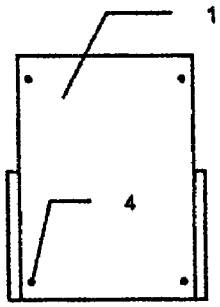
Figure 5:
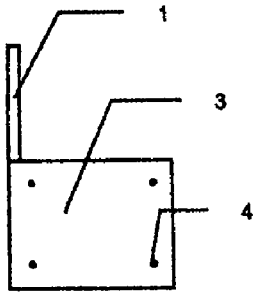

FIG. 3, FIG. 4 and FIG. 5 show the positions of the slot-holes 4 respectively in a front view, in a view on the back, and in a view on the side. In the front view of FIG. 3 is, apart from the drilled holes 5 in the side boards 3, shown a desired position of storing clamps 6 in special slot-holes and the holding of the clamp-tapper 8. The latter is also to be used as a clamp-lever and is enlarged in FIG. 8.

Figure 6:
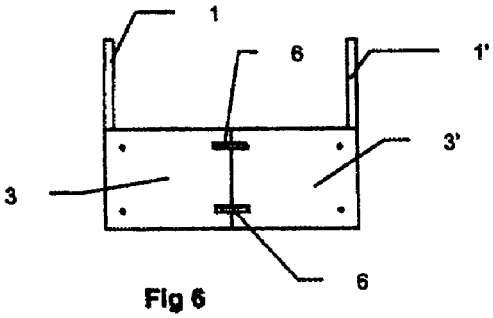
FIG. 6 a coupling of two chairs forming a doll's bed.

FIG. 6 shows coupling for the connection of two chairs forming a doll's bed in which the clamps 6 engage in slot-holes 4 of the side-boards 3 and 3' because the peg-ends 7 of the clamps are tightly wedged in the slot-holes by tapping.

Figure 7:
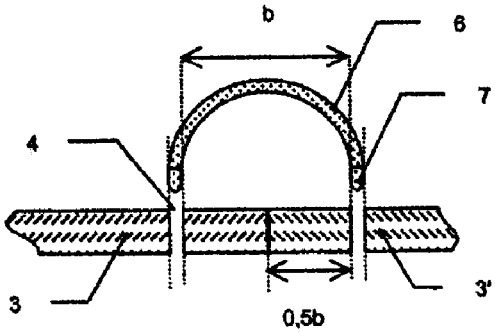
FIG. 7 an enlargement of a coupling with clamp and slot-holes.

FIG. 7 shows a number of details of the U-shaped clamp 6 of which the straight legs at the peg-ends 7 are parallel at b cm distance and are, in the preferred design, only a number of millimeters long in order to fit snuggly in the slot-holes and in order to tightly wedge after furthering the said the clamp legs by tapping them beyond their point of transition from straight to curbed in the U-shape. The tips of the peg-ends 7 are preferably rounded in order to ease the beginning of penetration into the slot-holes 4.

Figure 8:
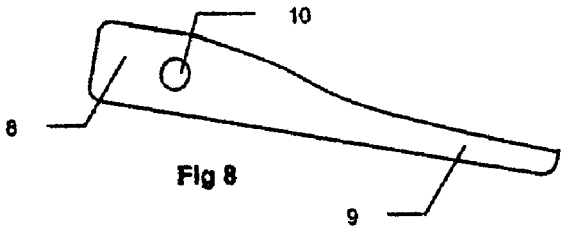
FIG. 8 an enlargement of a "design" club at which fat end clamps can be tapped for engaging their peg-ends in slot-holes and at which thin end a clamp can be levered for disengaging of clamps from slot-holes.

FIG. 8 shows a preferred design of a wooden "design" club serving at the fat end 8 as a clamp-tapper to tap the peg ends in the slot-holes and at the thin end a clamp-lever 9 to lift the peg-ends of the clamp from the slot-holes e.g. when the chairs are being disassembled. As is shown in FIG. 3, one of the clamps at the storage position can hold this "design" club in place for storage by putting one of its legs of the U through the hole 10 of the club.

FIGS. 9–16 are mostly self-explanatory. They show a number of possibilities of furnishings in which the position of the U-shaped clamps 6 are elucidated.

Figure 9:
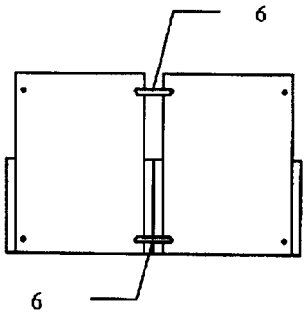
FIG. 9, FIG. 10, FIG. 11, FIG. 12, FIG. 13, and FIG. 14 show a number of combination possibilities of coupled child's chairs forming respectively: a small bench, a doll's crib, an occasional table, a throne (double height chair), a high riser or umpire chair, and a puppet theatre.

FIG. 9 shows a view on the back of two coupled chairs forming a small two-seater.

Figure 10:
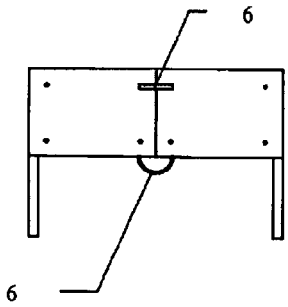

FIG. 10 shows a view on the side of two coupled chairs forming a doll's crib.

Figure 11:
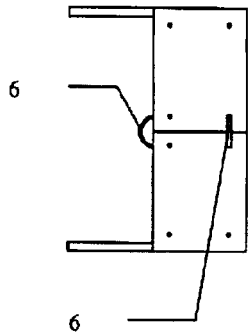

FIG. 11 shows a view on the side of two coupled chairs forming an occasional table.

Figure 12:
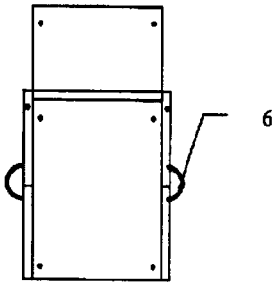

FIG. 12 shows a front view of two coupled chairs forming a throne with an enclosure underneath to be used as a "secret" small "treasure" room.

Figure 13:
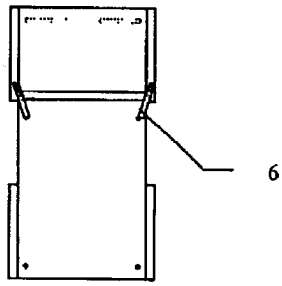

FIG. 13 shows a front view of a coupling whereby the top chair is coupled upside-down forming an umpire chair or a doll's high-riser.

Figure 14:
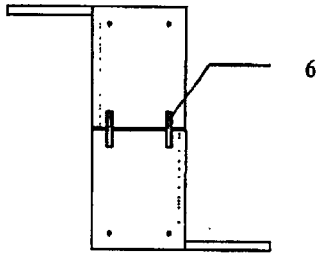

FIG. 14 shows a view on the side of a coupling forming a small puppet theatre.

Figure 15:
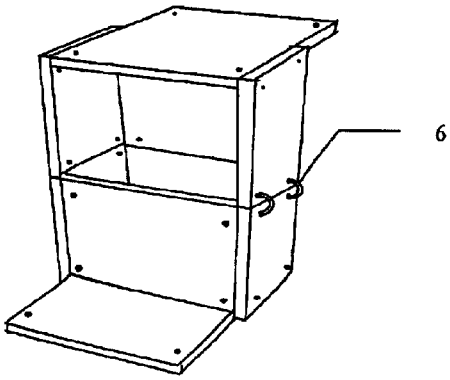
FIG. 15 shows a puppet theatre in perspective.
Figure 16:
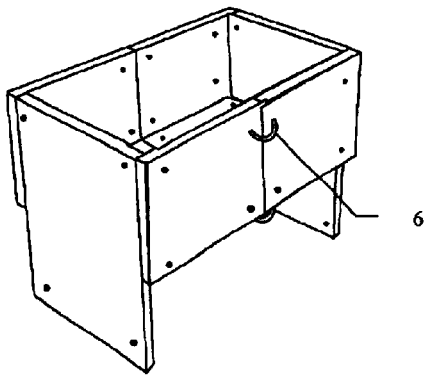
FIG. 16 shows a doll's crib in perspective.

Finally, FIG. 15 and FIG. 16 show in perspective respectively a puppet theatre and a doll's crib.

With the above-discussed drawings only a number of possibilities of couplings have been shown and described. It will be obvious that much more playthings can be constructed with more then two of the chairs clamped together. Such possibilities will be left to the imagination of the children and their nursery school teachers and all others that want to exploit the chairs as child's seat and as plaything.

What is claimed is:

1. A child's chair comprising:

four rectangular planar members connected together to form a back-plane, a seat-plane and side-planes, wherein the planar members are perpendicular to each other; and a plurality of U-shaped clamps to enable coupling of identical chairs, each of said clamps having a pair of peg-ends spaced from one another by a predetermined span-width, said planar members being provided with slot-holes for providing access and egress of the peg-ends of said clamps, each of said slot-holes being positioned in one of said back-plane, said seat-plane and said side-planes at a distance of half said span-width from another of said back-plane, said seat-plane and said side-planes, wherein said peg-ends have a diameter equal to a diameter of said slot-holes and wherein said peg-ends have tips that are rounded for easy access into said slot-holes, said planar members including a back-board and a pair of side-boards, extra slot-holes being formed in front surfaces of the side-boards parallel to said side-planes and said seat-plane, said extra slot-holes being located at a distance equal to said span-width from slot-holes at a top of the back-board of an identical chair that is placed upside down and reversed on top of the child's chair.

2. The child's chair according to claim 1, wherein one of said planar members is back-board having a leaning part, another of said planar members being a sitting board having a thickness, said leaning part having a height equal to a height of the seat-plane from a ground plane minus the thickness of the sitting board.

3. The child's chair according to claim 1, wherein one or more additional slot-holes are provided in at least one of said planar members for storage of idle clamps having peg-ends snugly receivable in said additional slot-holes.

4. The child's chair according to claim 3, wherein said planar members include a back-board and a seat board, said additional slot-holes being provided at an inner plan of said back-board underneath said seat board.

5. The child's chair according to claim 1, further comprising a clamp tapper tool having a club's fat-end as one integral part with a club's thin-end handle as another integral part, said thin-end handle also serving as a clamp lever tool, said clamp tapper tool being pierced with a hole for enabling easy storage.

6. A child's toy furniture assembly comprising:

two chairs each including four rectangular planar members connected together to form a back-plane, a seat-plan and side-planes, wherein the planar members are perpendicular to each other; and a plurality of U-shaped clamps to enable coupling of said chairs to one another in any of a multiplicity of different configurations, each of said clamps having a pair of peg-ends spaced from one another by a predetermined span-width, said planar members being provided with slot-holes for providing access and egress of the peg-ends of said clamps, each of said slot-holes being positioned in one of the back-plane, the seat-plane and the side-planes of a respective one of said chairs at a distance of half said span-width from another of the back-plane, the seat-plane and the side-planes of said one of said chairs, and wherein at least one or more additional slot-holes is provided in at least one of said planar members for storage of idle clamps having peg-ends snugly receivable in said additional slot-holes.

7. The child's toy furniture assembly according to claim 6, wherein one of said planar members of a selected one of said chairs is a back-board having a leaning part, another of said planar members of said selected one of said chairs being a sitting board having a thickness, said leaning part having a height equal to a height of the seat-plane of said selected one of said chairs from a ground plane minus the thickness of the sitting board.

8. The child's toy furniture assembly according to claim 6 wherein the planar members of one of said chairs include a back-board and a seat board, said additional slot-holes being provided at an inner plane of said back-board underneath said seat board.

9. The child's toy furniture assembly according to claim 6 wherein the planar members of each of said chairs include a back-board and a pair of side-boards, extra slot-holes being formed in front surfaces of the side-boards of each one of said chairs parallel to a respective one of said side-planes and a respective said seat-plane, said extra slot-holes being located at a distance equal to said span-width from slot-holes at a top of the back-board of the other chair, which is placed upside down and reversed on top of the one chair.

10. The child's toy furniture assembly according to claim 6, further comprising a clamp tapper tool having a club's fat-end as one integral part with a club's thin-end handle as another integral part, said thin-end handle also serving as a clamp lever tool, said clamp tapper tool being pierced with a hole for enabling clamping by one of said clamps to a planar member of one of said chairs for easy storage.

11. A child's toy furniture assembly comprising:

two chairs each including four rectangular planar members connected together to form a back-plane, a seat-plane and side-planes, wherein the planar members are perpendicular to each other; and a plurality of U-shaped clamps to enable coupling of said chairs to one another in any of a multiplicity of different configurations, each of said clamps having a pair of peg-ends spaced from one another by a predetermined span-width, said planar members being provided with slot-holes for providing access and egress of the peg-ends of said clamps, each of said slot-holes being positioned in one of the back-plane, the seat-plan and the side-planes of a respective one of said chairs at a distance of half said span-width from another of the back-plane, the seat-plane and the side-planes of said one of said chairs, and further composing:

a clamp tapper tool having a club's fat-end as one integral part with a club's thin-end handle as another integral part, said thin-end handle also serving as a clamp lever tool, said clamp tapper tool being pierced with a hole for enabling clamping by one of said clamps to a planar member of one of said chairs for easy storage.

* * * * *